US006098343A

United States Patent [19]

Brown et al.

[11] Patent Number: 6,098,343

[45] Date of Patent: Aug. 8, 2000

[54] GUTTER FOR WINDOW AND DOOR OPENINGS OF A BUILDING STRUCTURE

[76] Inventors: Glenn E. Brown, 3190 Crystal Heights Dr., Soquel, Calif. 95073; Gregory A. Moffitt, 8620 Wagner Creek Rd., Talent, Oreg. 97540

[21] Appl. No.: 09/166,729

[22] Filed: Oct. 5, 1998

[51] Int. Cl.[7] ..... E06B 7/00

[52] U.S. Cl. ..... 52/11; 52/58; 52/97; 52/209; 52/302.3; 52/745.16; 49/471; 49/476.1

[58] Field of Search ..... 52/11, 14, 15, 52/58, 97, 209, 211, 302.1, 302.3, 734.1, 745.15, 745.16, 302.7, 204.52, 204.2, 212, 656.5, 656.6; 49/471, 476.1; 296/154

[56] References Cited

U.S. PATENT DOCUMENTS

| | | | |
|---|---|---|---|
| 1,231,621 | 7/1917 | Lane | 49/476.1 |
| 1,392,305 | 10/1921 | Day | 52/209 |
| 1,429,203 | 9/1922 | Hartstra | 49/476.1 |
| 1,846,176 | 2/1932 | Barringer | 49/476.1 |
| 1,861,778 | 6/1932 | Blackhall et al. | 52/11 |
| 1,896,262 | 2/1933 | Weber | 52/97 |
| 2,066,712 | 1/1937 | Barringer | 49/476.1 |
| 2,202,482 | 5/1940 | Dahl | 49/476.1 |
| 2,482,170 | 7/1949 | Gunnison . | |
| 2,581,727 | 6/1952 | Soplata . | |
| 2,732,045 | 12/1956 | Herlocker . | |
| 2,755,894 | 7/1956 | Weyl et al. | 52/97 |
| 2,905,983 | 9/1959 | Ritz | 52/209 |
| 3,638,372 | 2/1972 | Rosenthal et al. . | |
| 3,900,044 | 8/1975 | Seidman | 52/171.3 X |
| 4,064,666 | 12/1977 | Kinlaw | 52/171.3 |
| 4,154,033 | 5/1979 | Krueger et al. | 52/209 |
| 4,555,882 | 12/1985 | Moffitt et al. . | |
| 5,253,456 | 10/1993 | Todd | 52/11 |
| 5,653,068 | 8/1997 | Moody et al. | 52/97 |
| 5,921,056 | 7/1999 | Weiss et al. | 52/212 X |

FOREIGN PATENT DOCUMENTS

| | | | |
|---|---|---|---|
| 117653 | 5/1930 | Austria | 52/209 |
| 198927 | 8/1958 | Austria | 52/209 |
| 270765 | 12/1950 | Switzerland | 52/211 |
| 454080 | 9/1936 | United Kingdom | 52/209 |
| 2021667 | 12/1979 | United Kingdom | 52/209 |
| 2209787 | 5/1989 | United Kingdom | 52/209 |
| 2211234 | 6/1989 | United Kingdom | 52/209 |

*Primary Examiner*—Laura A. Callo
*Attorney, Agent, or Firm*—James D. Givnan, Jr.

[57] ABSTRACT

A gutter attachable to wall structure of a building for the reception of moisture and the discharge of same harmlessly to an exterior wall surface. The gutter includes a rear wall for disposition below a sill pan mounted in a door or window opening of the building structure. Extensions on the ends of the gutter also receive moisture from sill pan or structural surfaces of the building. Moisture from a sill pan is directed toward openings in a front wall of the gutter located above an exterior wall surface of the building structure. A trim plate conceals the openings. The extensions include convergent walls to avoid interference with the wall covering material later applied.

14 Claims, 1 Drawing Sheet

GUTTER FOR WINDOW AND DOOR OPENINGS OF A BUILDING STRUCTURE

BACKGROUND OF THE INVENTION

The present invention pertains generally to a gutter for the collection of moisture or condensation subjacent a window frame or door frame of a home or other building structure and the discharge of same to the exterior of the structure to avoid damage, such as dry rot, which would otherwise occur.

It is accepted practice in the construction trade to install metal or plastic barriers, termed sill pans, of Z-shape in section on window or door sills during construction for the purpose of directing condensation away from the sill. Such a pan is disclosed in U.S. Pat. No. 4,555,882, issued to the present inventors, which extends lengthwise of a sill plate at the lower extremity of a window or door opening. The lowermost member of a window or door frame normally rests on the sill pan. Such pans terminate forwardly in a depending lip which overlies sheathing of an exterior building wall. While moisture and condensation are diverted by such pans, no provision is made for directing collected water outwardly to the exterior surface of the building wall with the result that water damage is done both to the sheathing and the wall treatment or surface material thereon. The remedy to such damage is costly in that the exterior surface of the structure must be removed and any damaged sheathing or wall material replaced.

U.S. Pat. No. 2,482,170 discloses window sill construction including an outwardly projecting sill component for discharge of water away from the exterior surface of a building wall. A second sill member is directed toward the interior of the building structure and has a lip projecting inwardly from an inner wall of the structure and terminating above a receptacle to receive condensation occurring on the inner surfaces of a window.

U.S. Pat. No. 2,581,727 discloses a Z-shaped pan in place on a window frame member. Condensation on the inner surface of window glass gravitates through openings in a second plate component onto the pan for passage through additional openings in still another Z-shaped member. The patent does not address disposal of moisture occurring along upright components of the window frame. No provision is disclosed for collecting moisture received from the face of upright members of a window frame.

U.S. Pat. No. 2,732,045 discloses a flashing about a window or door frame with the lowermost member of the frame received within a channeled portion of the flashing which terminates forwardly offset from the exterior surface of a wall. No provision is made for collecting condensation or moisture from the upright members of a window or door frame and directing same into a trough for discharge onto the exterior surface of a building wall.

U.S. Pat. No. 3,638,372 discloses the lowermost member or sash of a window as being of plastic material having a channel formed along the sash interior for the collection of condensation forming on the window interior. Openings in the plastic sash direct condensation from the channel to a cover plate which terminates forwardly offset from the outer surface of a window frame member. The channel terminates endwise at the upright edges of each side member of the window frame as disclosed in FIG. 2 of the patent drawings.

U.S. Pat. No. 4,555,882 discloses a Z-shaped pan structure for installation on a sill prior to setting in place a window or door frame with the pan having a frontal lip depending over sheathing material of a wall structure. The pan additionally includes upright ends and contiguous frontal vertical flanges to protect building wall components from moisture. No provision is made for collecting and discharging water to the exterior surface of a building wall.

SUMMARY OF THE PRESENT INVENTION

A gutter is provided for installation on an external wall of a building structure for the collection of moisture received from a pan in place on the sill plate of a window or door opening to prevent escape of moisture onto sheathing or wall covering material resulting in damage thereto. The gutter includes end segments each extending beyond a pan end to collect moisture from laterally extending surfaces of the pan. A gutter rear wall and the rear wall of a gutter end segment are of tapered thin wall construction to permit insertion below or inwardly of the frontal lip of a Z-shaped pan to insure deposit into the gutter of any moisture collected on pan surfaces. A frontal wall of the gutter is located in a plane substantially coplanar with the exterior surface of a wall treatment, e.g., synthetic stucco to insure the deposit of collected water on the external surface of the wall treatment and away from internal wall surfaces.

Gutter construction may be by low cost extrusion facilitating on-site dimensioning of the gutter to different window and door widths. Gutter end segments are readily attachable in a watertight manner to the gutter enabling the collection of moisture from surfaces laterally offset from the window or door opening. A trim piece serves to conceal moisture discharge openings and may be used to provide access to fasteners attaching the gutter to a wall component of the buildng.

DETAILED DESCRIPTION OF THE PREFERRED EMBODIMENTS

Figures 1, 2, 3, 4:
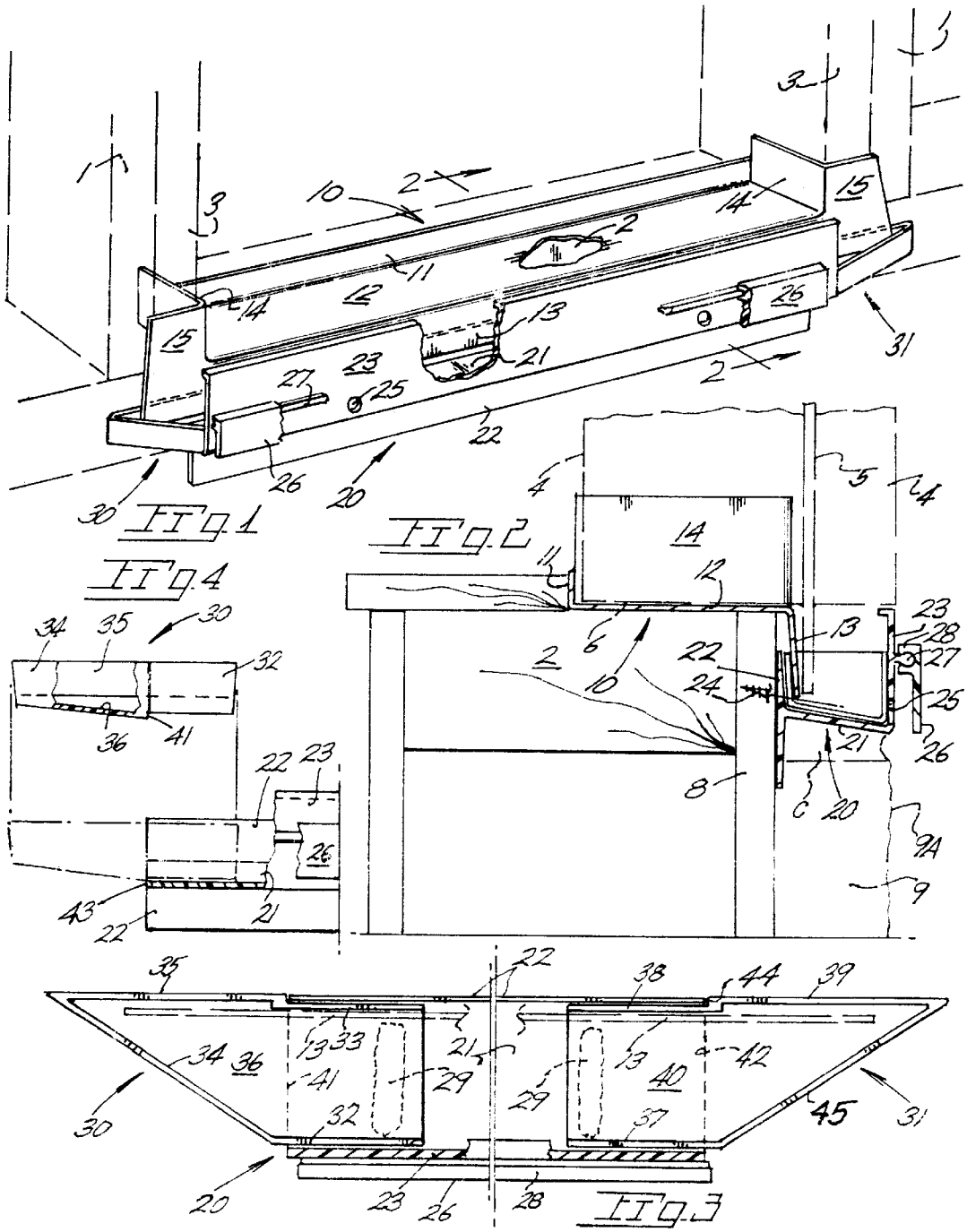
FIG. 1 is a perspective view of the present invention operatively disposed on a building wall structure shown in phantom lines.
FIG. 2 is a vertical sectional view taken along line 2—2 of FIG. 1.
FIG. 3 is a plan view of the gutter shown with a section removed.
FIG. 4 is a front elevational view of a gutter fragment with an end segment exploded from an operative position on the gutter.

With continuing attention to FIGS. 1 and 2 of the above described drawings, wherein reference numerals indicate parts similarly hereinafter identified, building wall construction includes wall studs 1 shown in phantom lines with other framing components including a sill plate 2 of a house or other building structure. While the following description is with reference to a window, the described invention is equally useful in a door installation. Window receiving frame components are indicated at 3. Sill plate 2 partially defines an opening in a wall for reception of a window assembly including upright window frame members 4 (FIG. 2) and a window flange 5 integral with frame members 4 and a lowermost window frame member 6. A Z-shaped sill pan is indicated generally at 10 and includes an inner or rear wall flange 11, a horizontal expanse 12 and a front lip 13. The pan structure 10 is preferably formed of plastic with frontal lip 13 being somewhat flexible and hence displaceable away from sill 2 as later explained. Pan assembly 10 may include upright end flanges at 14, contiguous with rear flange 11 and expanse 12 of the pan, and with outwardly directed vertical flanges at 15 integral with end walls 14 and pan frontal lip 13. Such a sill pan is the subject of U.S. Pat. No. 4,555,882 issued to the present inventors and incorporated herein by reference.

The present gutter construction is indicated generally at 20 and includes a trough for installation forward and below the top surface of sill plate 2 of a window or door opening of a building wall. The trough 20 includes a bottom wall 21, a rear wall 22, and a frontal wall 23. Rear wall 22 is adapted to abut the exterior or frontal side of a building wall component such as sheathing at 8 with fasteners at 24. Bottom wall 21 is of front to rear dimension as shown in FIG. 2 to offset frontal trough wall 23 from sheathing 8 and locating the trough wall substantially even with the exterior surface 9A of a wall covering 9. Apertures 25 in front wall 23 serve to discharge collected moisture or water from the trough. Bottom wall 21 is inclined downwardly and outwardly relative rear wall 22 of the trough to promote drainage. A trim plate 26 may be utilized to conceal apertures 25 and is removably mounted by means of a rib 27 formed integral with trough front wall 23 and about which a rib engaging channel 28 is slidably engaged. Trough rear wall 22 is of upwardly tapered section for insertion behind lip 13. The trough is preferably of extruded manufacture of polyvinylchloride material, as is plate 26, both of which lend themselves to cutting or dimensioning at the work site to suit door or window sizes. Calking is indicated at C.

Trough extensions or end segments generally at 30 and 31 are carried by the left and right hands of trough 20 and are preferably attached in watertight fashion by a cement 29 suitable for use with plastic. The trough end segments 30–31 are insertably engageable with the trough ends. End segment 30 includes upright walls 32 and 33 merging with convergent walls 34 and 35 and all of which walls terminate downwardly in a bottom wall 36 inclined downwardly with an inner portion being flush in place on trough bottom wall 21. Similarly right hand end segment 31 includes a front wall 37, a rear wall 38, outwardly converging walls 45 and 39 and a bottom wall 40 in surface contact with trough wall 21. A shoulder at 41 and 42 on each trough end segment seats against a trough end 43–44 to properly locate each end segment on the trough. The end segments are preferably of outwardly convergent shape, in plan view, to avoid interference with the application of the exterior wall treatment 9.

A typical installation of the present gutter for window and door openings includes cutting off a length of trough approximately equivalent to the width of the window or door opening. Trough end segments are each inserted into the ends of the trough for retention therein by a quantity of cement previously applied to the mating overlapping surfaces. The trough rear wall is subsequently inserted in place between frontal depending lip 13 of a previously installed sill pan in place on the window or door sill with trough end segments 30–31 receiving laterally directed vertical flanges 15 of the sill pan. Fasteners 24 are then inserted through the rear wall of the trough securing same in place on the building structure. With the trough in place, moisture gravitating from sill pan frontal lip 13 and flanges 15 will be discharged from the trough through front wall apertures 25 and harmlessly onto an exterior surface of the building.

While we have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A gutter for attachment to exterior wall structure of a house or other building subjacent a door or window opening partially defined by a sill and having a sill pan thereon, said sill pan having a frontal depending lip, said gutter including, a trough having a rear wall for securement to the wall structure below the window or door opening, said trough also having a bottom wall and a front wall with openings in the latter for discharge of moisture received from the sill pan to the exterior wall structure of a house, trough extensions carried by said trough and extending in a lengthwise direction of the trough beyond the ends of the trough, said trough and said extensions serving to receive moisture gravitating from the sill pan, said trough extensions having bottom walls inclined in a forward and downward direction relative the trough rear wall for discharge of collected moisture.

2. The gutter claimed in claim 1 wherein each of said trough extensions additionally include front and rear walls which converge at a point offset from said trough.

3. The gutter claimed in claim 2 wherein said trough extensions are in overlapped engagement with corresponding trough walls.

4. The gutter claimed in claim 1 wherein said rear wall of the trough is of tapered vertical cross section to facilitate upward insertion rearwardly of the sill pan lip.

5. A gutter for external installation on a wall component of a building structure below a window or door opening in the wall component to collect and discharge moisture received from a sill pan in the opening toward an outer surface of the wall component, said gutter comprising, a trough having a rear wall for securement to the wall component of the building structure below a window or door opening, said trough including a bottom wall and a front wall, the latter defining an aperture for the discharge of moisture to the outer surface of the wall component, and trough extensions carried at the ends of the trough and extending in a lengthwise direction of the trough beyond said trough ends for the reception of moisture from wall component surface areas of the building structure located adjacent the window or door opening, a trim plate on said trough front wall and means for removably attaching said trim plate to said trough front wall.

6. The gutter claimed in claim 5 wherein said trough extensions have bottom walls inclined in a forward and downward direction relative the trough rear wall for discharge of collected moisture.

7. The gutter claimed in claim 5 wherein each of said trough extensions include front and rear walls which converge at a point offset from said trough.

8. The gutter claimed in claim 7 wherein said front and rear walls of said trough extensions are in overlapped engagement with trough walls.

9. In combination, a sill pan for attachment to a window or door sill of a building structure, said pan having a frontal depending lip from which moisture is discharged, a gutter for attachment to the building structure and having a rear, a bottom and a front wall, and extensions each in place on a gutter end and each of said extensions terminating at a location offset outwardly from the gutter end, said front wall of the gutter offset in an outward direction from said rear wall and having apertures therein for the discharge of gutter collected moisture to an exterior surface of the building structure.

10. The combination claimed in claim 9 wherein said extensions each have convergent walls.

11. The combination claimed in claim 9 wherein said extensions additionally have rear, front and bottom walls in surfacial engagement with the gutter rear, front and bottom walls.

12. The combination claimed in claim 11 wherein said extensions are attachable to said gutter by a cement.

13. The combination claimed in claim 9 wherein said frontal depending lip of the sill pan extends into said gutter and said extensions.

14. The method of collecting moisture from surfaces defining a window or door opening of a building structure and discharging same to the exterior surface of the building structure consisting of the steps attaching a sill pan to a window or door sill, cutting a gutter to a length approximately equal to the width of a window or door opening, attaching extensions to the gutter ends, attaching the gutter to the building structure below the sill pan with the sill pan in partial inserted engagement with the gutter and said extensions, and said gutter having moisture discharge openings located above a portion of the exterior surface of the building wall to deposit collected moisture thereon.

* * * * *